US007367852B2

(12) United States Patent
Niggemann et al.

(10) Patent No.: US 7,367,852 B2
(45) Date of Patent: May 6, 2008

(54) CONNECTING AND SWITCHING ARRANGEMENT

(75) Inventors: Matthias Niggemann, Lemgo (DE); Stefan Fehling, Lage (DE); Walter Hanning, Detmold (DE); Wolfgang Schild, Herford (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/788,423

(22) Filed: Apr. 20, 2007

(65) Prior Publication Data

US 2007/0254520 A1 Nov. 1, 2007

(30) Foreign Application Priority Data

Apr. 26, 2006 (DE) ..... 20 2006 006 626 U

(51) Int. Cl.
*H01R 9/22* (2006.01)

(52) U.S. Cl. ..... 439/715

(58) Field of Classification Search ..... 439/709, 439/711, 715–717
See application file for complete search history.

(56) References Cited

U.S. PATENT DOCUMENTS

| | | | | |
|---|---|---|---|---|
| 4,020,301 A | | 4/1977 | Ericson | |
| 5,295,870 A | | 3/1994 | Rei | |
| 5,318,461 A | * | 6/1994 | Frikkee et al. | 439/715 |
| 5,629,831 A | * | 5/1997 | Eggert et al. | 361/624 |
| 5,658,172 A | * | 8/1997 | Schmidt et al. | 439/716 |
| 5,735,700 A | * | 4/1998 | Hohorst | 439/98 |
| 6,425,770 B1 | * | 7/2002 | Lostoski et al. | 439/76.1 |
| 6,506,071 B2 | * | 1/2003 | Lange | 439/358 |
| 6,848,951 B1 | * | 2/2005 | Bechaz et al. | 439/716 |
| 7,179,137 B1 | * | 2/2007 | Quendt et al. | 439/828 |
| 2003/0045178 A1 | * | 3/2003 | Huiskamp et al. | 439/709 |
| 2003/0139099 A1 | * | 7/2003 | Ude et al. | 439/715 |
| 2003/0224665 A1 | * | 12/2003 | Neumann et al. | 439/638 |

FOREIGN PATENT DOCUMENTS

DE 692 23 483 T2 4/1993

* cited by examiner

*Primary Examiner*—Ross Gushi
(74) *Attorney, Agent, or Firm*—Lawrence E Laubscher, Sr.; Lawrence E Laubscher, Jr.

(57) ABSTRACT

A terminal block connecting arrangement includes a first terminal block having a first electrical contact, an electrical device having a second electrical contact, a test terminal block arranged between the electrical apparatus and the first terminal block for displacement between a first test position spaced from the electrical apparatus and a contact position adjacent the electrical apparatus, the test terminal block having a double-ended electrical contact. A spring-biased detent device normally retains the test terminal block in the test position. As the first terminal block is progressively displaced toward the electrical device, the first contact is brought into engagement with one end of the contact on the test terminal block. Upon further displacement of the first terminal block toward the electrical device, the detent device is released, and the test terminal block is displaced to effect connection of the first contact with the second contact via the two-ended test contact.

11 Claims, 5 Drawing Sheets

CONNECTING AND SWITCHING ARRANGEMENT

BACKGROUND OF THE INVENTION

1. Field of the Invention

A terminal block connecting arrangement includes a first terminal block having a first electrical contact, an electrical device having a second electrical contact, a test terminal block arranged between the electrical apparatus and the first terminal block for displacement between a first test position spaced from the electrical apparatus and a contact position adjacent the electrical apparatus, the test terminal block having a double-ended electrical contact. Spring-biased detent means normally retain the test terminal block in the test position. As the first terminal block is progressively displaced toward the electrical device, the first contact is brought into engagement with one end of the contact on the test terminal block. Upon further displacement of the first terminal block toward the electrical device, the biasing force of the detent device is released, and the test terminal block is displaced to effect connection of the first contact with the second contact via the two-ended test contact.

2. Description of Related Art

Various arrangements for connecting terminal blocks to control panels and the like have been proposed in the prior art, as evidenced by the U.S. patents to Ericson et al U.S. Pat. No. 4,020,301, Rei et al U.S. Pat. No. 5,295,870, and the German Patent No. 692 23 483 T2. It has been proposed to place the terminal block in an initial test position before completing the final connections between the components. These proposals have been relatively complex, and are not always reliable.

The present invention was developed to provide an improved terminal block connecting arrangement of simple structure in terms of design, and which assures in a positive manner the positioning of the components in the testing and final connecting conditions.

SUMMARY OF THE INVENTION

Accordingly, a primary object of the present invention is to provide an improved terminal block connecting arrangement in which a test terminal block is initially retained in the test position by spring-biased detent means, so that as a first terminal block is displaced toward the electrical device, a first contact on the terminal block is initially brought into electrical engagement with one end of a dual-ended test contact on the test terminal block. Subsequent displacement of the first terminal block toward the electrical device causes the retaining force of the detent means to be overcome, whereupon the test terminal block is displaced toward the electrical device to effect electrical contact between the first and second contacts via the test contact.

According to a more specific object of the invention, the test terminal block is supported by frame means for displacement relative to the electrical device. The detent means includes a lever that is pivotally mounted on the frame for engagement with a locking recess carried by the test terminal block. The frame means is either integral with the electrical device, or a separate device that is rigidly fastened to the electrical device.

As a result of the present invention, a simple terminal block connecting arrangement is provided that can be manufactures at a reasonable cost. The locking direction is so constructed that, first of all, the testing position can be determined in a clearly recognizable or detectable fashion.

The switch position of the connect position can be achieved only by further insertion of the first terminal block with sufficient force to overcome the resistance of the spring-biased detent means.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
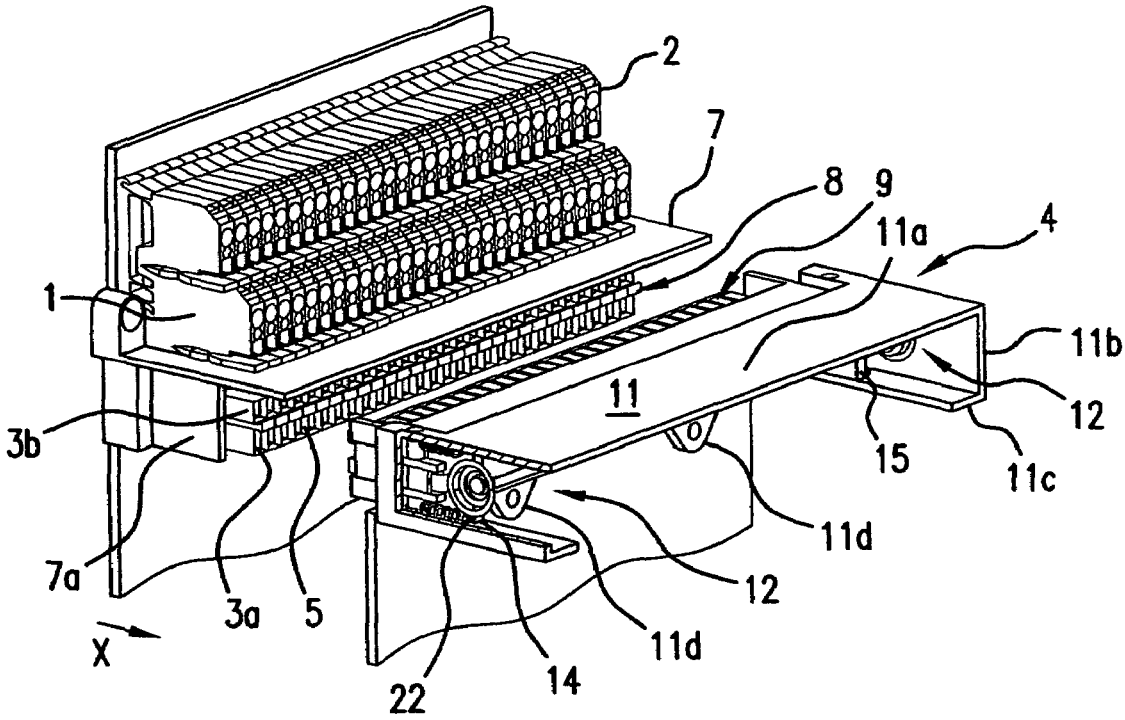
FIG. 1*a* is a perspective view of the terminal block arrangement with the first terminal block in the initial disconnect position.
Figure 1B:
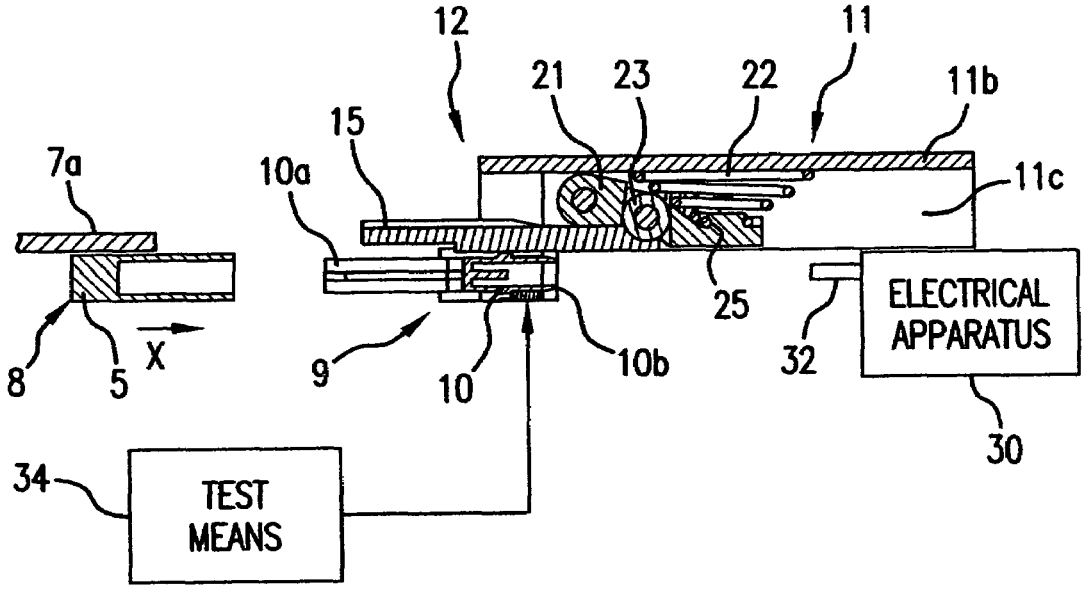
FIG. 1*b* is a detailed sectional view illustrating the condition of the detent means of the apparatus of FIG. 1*a;*

Referring first more particularly to FIGS. 1*a* and 1*b*, in accordance with the present invention connecting means 4 are provided for connecting the first contacts 5 of a first terminal block 1 with the contacts 32 of electrical apparatus 30. The first terminal block 1 includes first rows of terminals 2 arranged above a horizontal guide plate 7, and second rows 3*a* and 3*b* of first contacts 5 arranged beneath the guide plate 7. The contact rows 3*a* and 3*b* define a terminal block portion 8 that is adapted to engage a corresponding test terminal block 9 carried by a mounting frame 11 of the connecting means. As will be described in greater detail below, the test terminal block 9 is mounted for horizontal displacement relative to the mounting frame, which frame is rigidly fastened to the electrical apparatus 30. The frame 11 includes a horizontal planar top plate 11*a*, and a pair of downwardly depending vertical side walls 11*b* that terminate at their lower ends in inwardly bent support flange portions 11*c*. The test terminal block 9 is guided for sliding displacement in the mounting frame 11 by means of end walls 14 and 15 that are secured to the ends of the test terminal block 9 and that are slidably supported by the support flanges 11*c*. As will be described in greater detail below, after the first terminal block 1 has been displaced in the direction indicated by the arrow x relative to the electrical apparatus 30 from the fully disconnected portion of FIG. 1*a* toward the final connect position of FIG. 3*a*, via the intermediate test position of FIG. 2*a*, the first contacts 5 are brought into electrical engagement with the second contacts 32 via the dual-ended test contacts 10.

Referring more particularly now to FIGS. 1*a* and 1*b*, the first terminal block portion 8 carried by the first terminal block 1 is arranged between vertical side wall portions 7*a* that extend downwardly from the sides of the guide plate 7. The first terminal block 1 is arranged for displacement in the horizontal direction x from the illustrated disconnect position toward the electrical apparatus 30 having contacts 32 to which the first contacts 5 are to be electrically connected. Arranged opposite the first contacts 5 are dual-ended test contacts 10 that are carried by the test terminal block 9. At one end, the test contact has a first end portion 10*a* adapted for connection with the first contacts 5 on the first terminal block 1, and at their other end the test contacts 10 are provided with second end portions 10*b* that are adapted for electrical engagement with the second contacts 32 of the electrical apparatus 30.

Figure 2A:
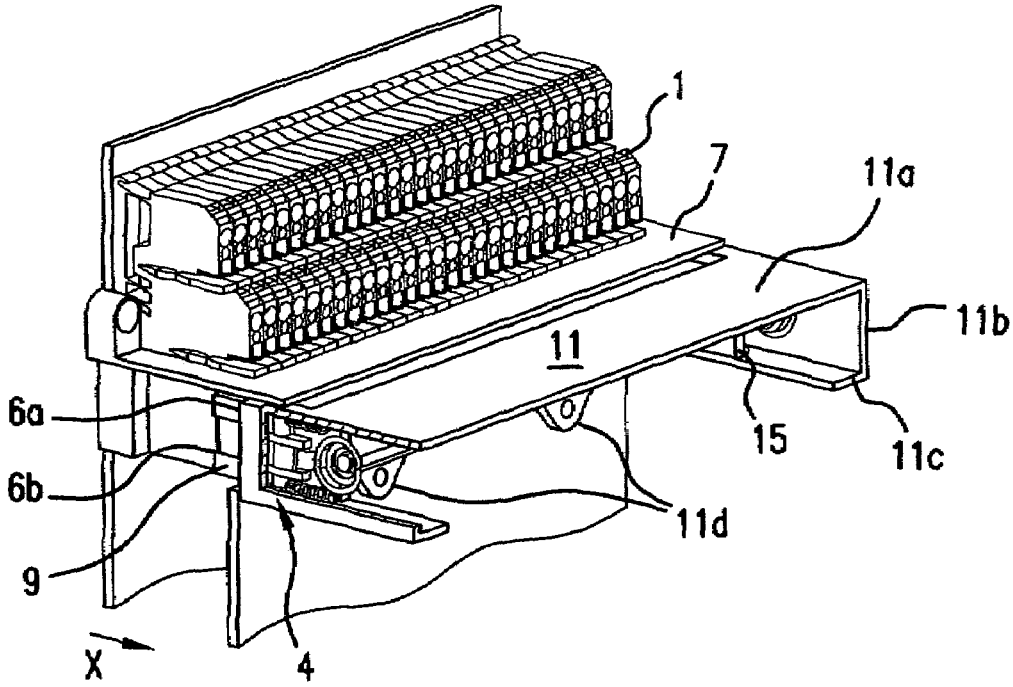
FIG. 2*a* is a perspective view of the apparatus of FIG. 1*a* when the first terminal block is in the intermediate test position.
Figure 2B:
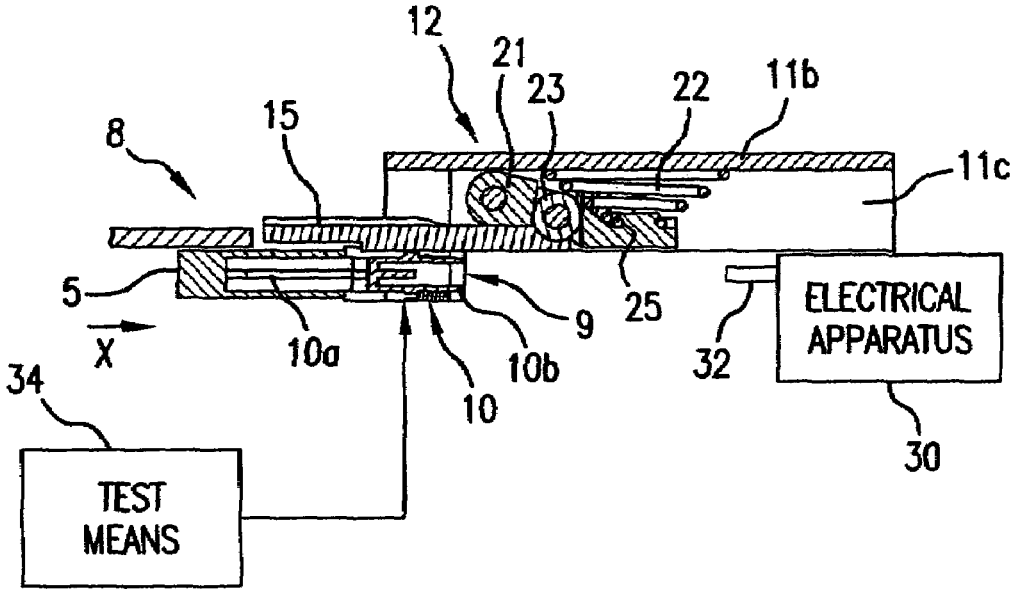
FIG. 2*b* is a corresponding detailed sectional view illustrating the condition of the detent means of FIG. 1*b;*
Figure 3A:
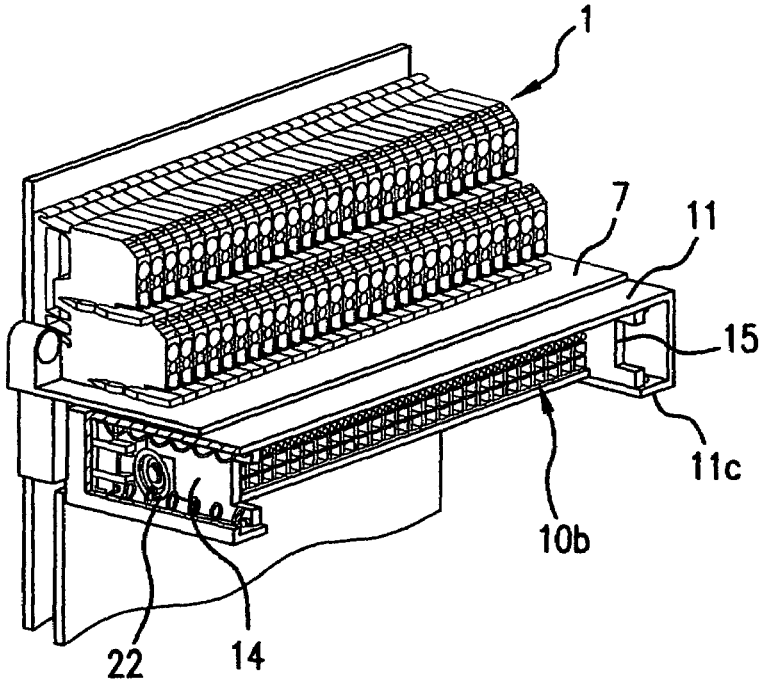
FIG. 3*a* is a perspective view of the apparatus of FIG. 1*a* when the first terminal block is in the final connect condition.
Figure 6:
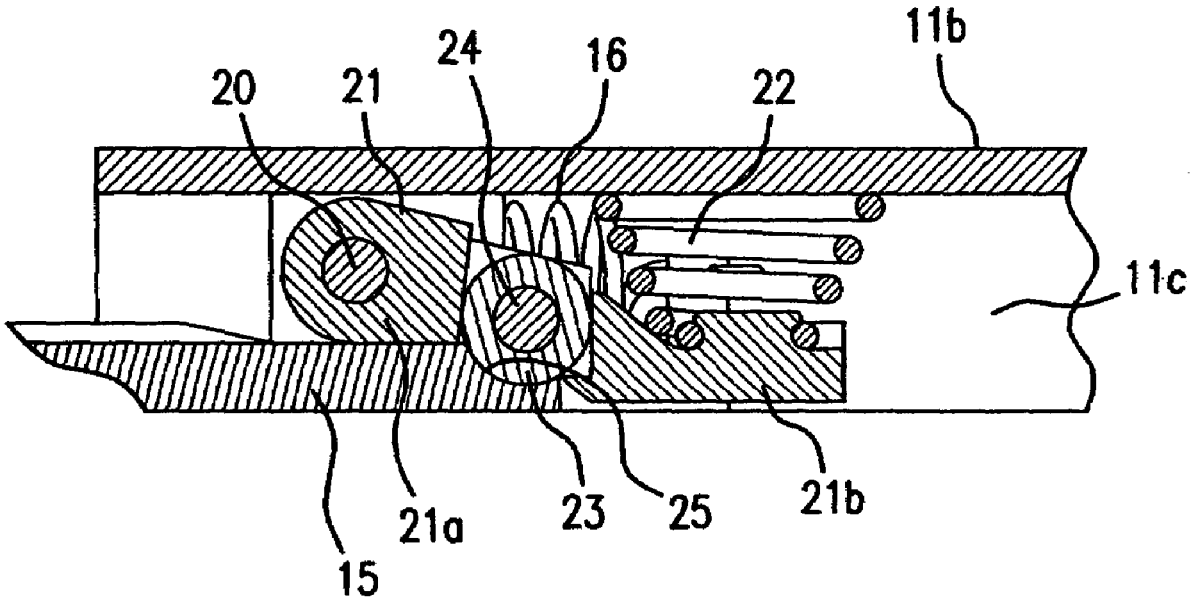
FIG. 6 is an enlarged detailed sectional view of the detent means when in the initial retaining condition of FIGS. 1*a* and 1*b*.

According to a characterizing feature of the present invention, detent means 12 are provided on the frame side walls 11*b* at each end of the test terminal block 9. As best shown in FIG. 6, the detent means 12 include a lever 21 having a first end portion 21*a* that is connected with the frame 11 for pivotal movement about a vertical pivot axes 20. The other end portion 21*b* of the lever 21 is engaged by a compression spring 22 that is arranged between the lever and the vertical side wall 11*b* of the frame 11. Intermediate its ends, the lever 21 is provided with a detent roller element 23 that rotates about the vertical pin 24 on the lever 21. The detent roller 23 is initially seated in a corresponding detent recess 25 defined in the end extremity of the side wall 15 of the terminal block 9. Thus, the detent means define a stop for supporting the test terminal block 9 relative to the frame 11 during the engagement of the contact end 10*a* by the first contact 5 on the first terminal block 1. As shown in FIGS. 2*a* and 2*b*, the test terminal block 9 is supported by the detent means 12 as the connection between the first contact 5 and the terminal end 10*a* is completed. At this time, test means 34 connected with the test contacts 10 serve to analyze the state of operation of the various circuits of the first terminal block 1.

Figure 3B:
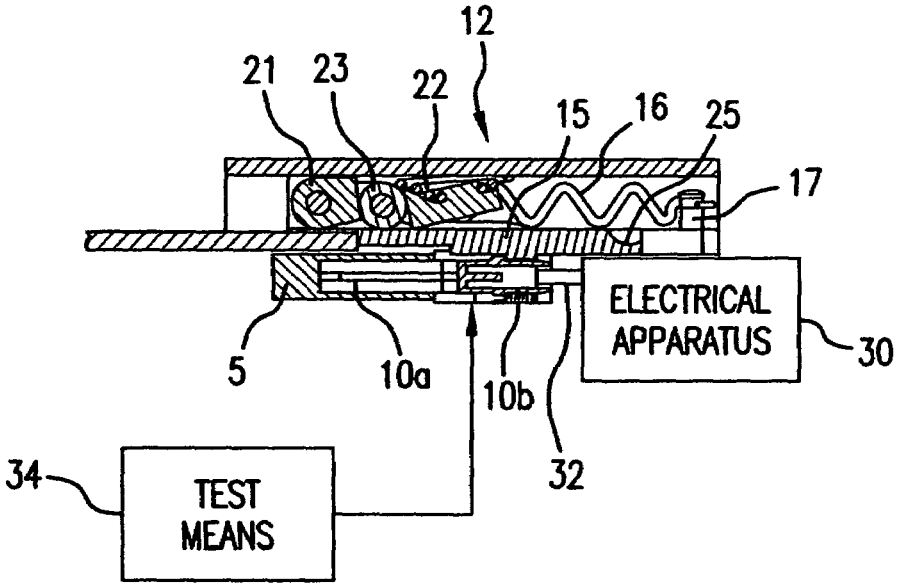
FIG. 3*b* is a corresponding detailed sectional view illustrating the condition of the detent means
Figure 4:
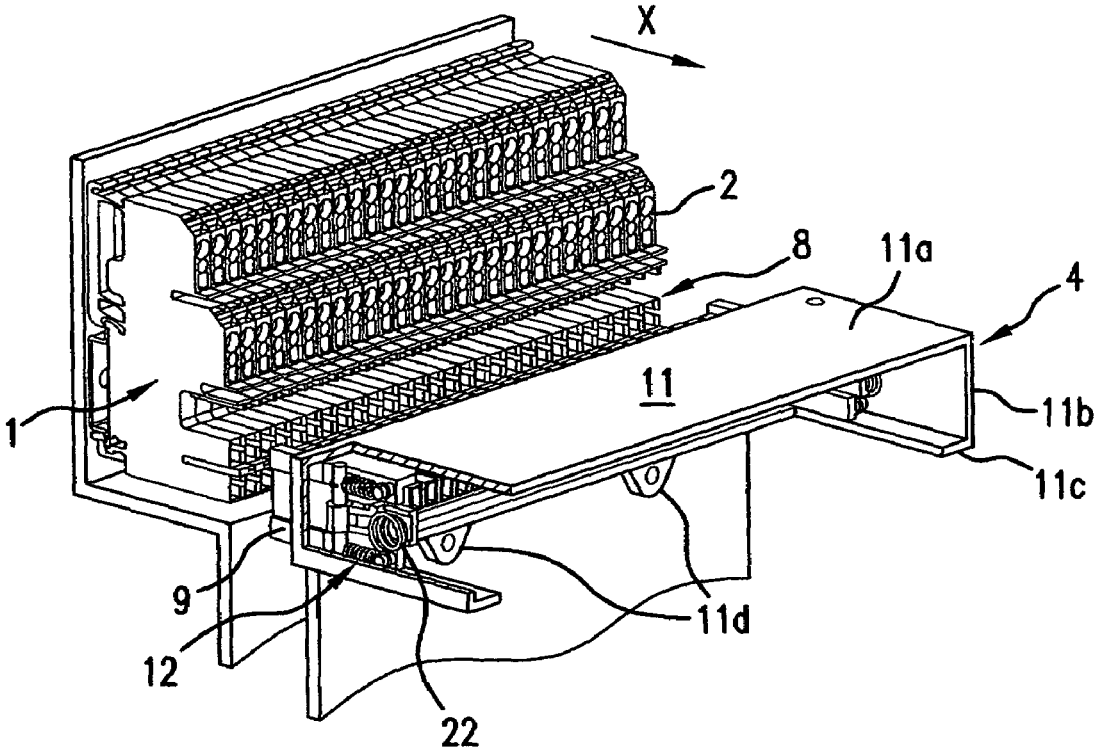
FIG. 4 is a detailed perspective view of the apparatus of FIG. 1*a*, with certain parts broken away or removed for purposes of illustration.
Figure 5:
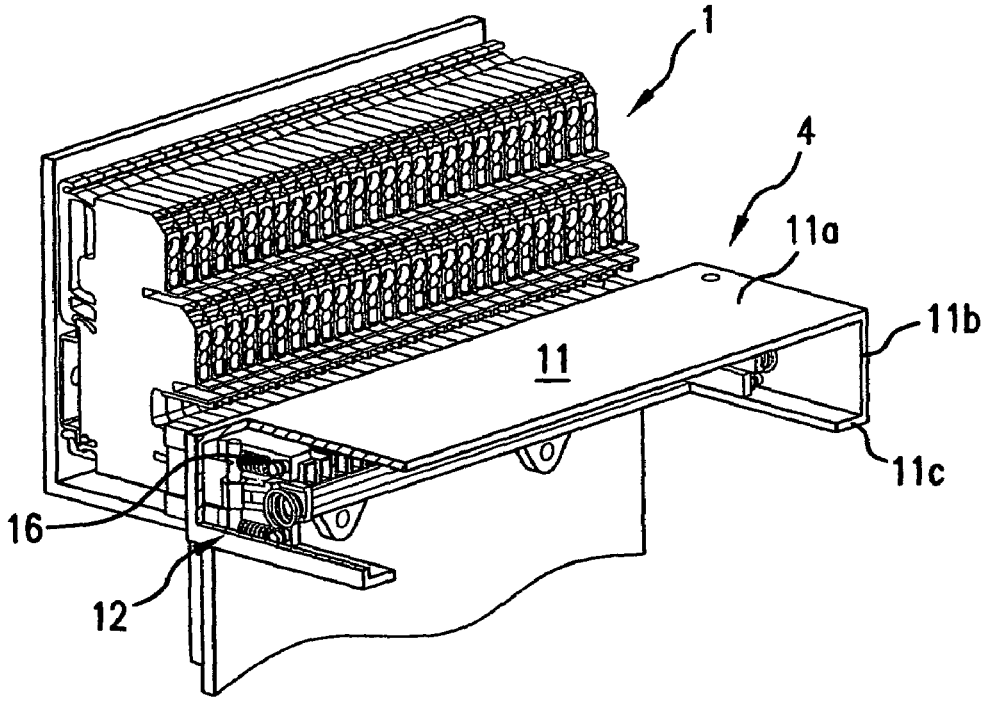
FIG. 5 is a corresponding detailed view of the apparatus of FIG. 2*a*.

Upon further displacement of the first terminal block 1 toward the electrical apparatus 30, the biasing force of the compression spring 22 is overcome, whereupon the lever 21 is pivoted toward the frame side wall 11*b*, thereby to release the detent roller 23 from the detent recess 21. The assembly of the first terminal block 8, the test terminal block 9, and the connected contacts 5 and 10*a* is then displaced by the first terminal block 1 to the right to effect engagement of the test terminal second end 10*b* with the corresponding second contact 32 of the electrical apparatus 30. Thus, when the first terminal block 1 is in the final connected position shown in FIGS. 3*a* and 3*b*, the first contact 5 is connected with the contact 32 of the electrical apparatus via the test contact 10.

As shown in FIGS. 3*a*, 3*b*, 4 and 5, tension springs 16 are provided having first ends connected with the test terminal block end walls 14 and 15 by mounting pins 17, and second ends connected with the frame 11, thereby biasing the test terminal block toward its initial test position shown in FIGS. 1*a* and 1*b*.

The frame 11 that supports the test terminal block 9 for sliding displacement may be fastened to the electrical apparatus 30 by means of bolts or screws extending through openings contained in the mounting tabs 1*d* on the planar flange portion 11*a*. Alternatively, the frame 11 could be formed integrally with the housing of the electrical apparatus 30.

The first terminal block 1, the connection means 4, and the electrical apparatus 30 that are to be connected in each case have a plurality of corresponding pin and socket contacts that are so designed that, by means of a mere translation movement, one can move all of the connection contacts into a connected and a disconnected condition. This can be done, for example, in the following manner: The connection contacts are made as pin-and-socket contacts, which, in each case, can be plugged into each other in direction x and which can be pulled out of each other again. The variant shown is to that extent purely exemplary. The illustrated pin-and-socket contacts would be mutually interchangeable regarding their arrangement on the first terminal block 1, on the connection means 4 and on the electrical apparatus 30. Thus, to disconnect the assembly shown in FIG. 3*a*, the first terminal block 1 is merely displaced to the left toward the disconnect condition of FIG. 1*a*, whereupon the test terminal block 9 is returned by tension spring 16 toward its initial test position shown in FIG. 1*b*.

While in accordance with the provisions of the Patent Statutes the preferred forms and embodiments of the invention have been illustrated and described, it will be apparent to those skilled in the art that changes may be made without deviating from the invention described above.

What is claimed is:

1. A terminal block connecting arrangement for connecting the electrical contacts of a terminal block with the electrical contacts of an electrical apparatus, comprising:

(a) a horizontal first terminal block (1) having at least one first contact (5);

(b) electrical apparatus (30) having at least one second contact (32), said first terminal block being displaceable in a given direction (x) from a first position remote from said electrical apparatus toward a second position adjacent said electrical apparatus;

(c) test means (34) including a test terminal block (9) extending parallel with said first terminal block and arranged between said first terminal block and said electrical apparatus, said test terminal block including at least one dual-ended test contact (10) having a first end portion (10*a*) adapted for electrical engagement with said terminal block first contact, and a second end portion (10*b*) adapted for engagement with said electrical apparatus second contact;

(d) connecting means (4) supporting said test terminal block for movement relative to said electrical apparatus in said given direction between a test position remote from said electrical apparatus and a connected position adjacent said electrical apparatus, said test contact second end portion being disconnected from said electrical apparatus second contact when said test terminal is in said test position, and in electrical engagement with said second contact when said test terminal block is in said connected position; and (e) detent means (12) normally retaining said test terminal block in said test position, (1) said detent means being operable to retain said test terminal in said first position when said first terminal block is initially displaced from said remote first position toward an intermediate position in which said first contact is brought into electrical engagement with said test contact first end portion;

(2) said detent means being releaseable when said first terminal block is subsequently displaced from said intermediate position toward said second position to permit displacement of said test terminal by said first terminal from said test position toward said connected position, thereby to connect said first contact with said second contact via said dual-ended test contact.

2. A terminal block arrangement as defined in claim 1, wherein said first terminal block includes a plurality of rows (3*a*, 3*b*) of first electrical contacts (5) arranged for cooperation with a plurality of rows (6*a*, 6*b*) of corresponding electrical contacts (10) arranged on said test terminal block.

3. A terminal block connecting arrangement as defined in claim 1, and further including:

(f) first spring means (16) biasing said test terminal toward said test position.

4. A terminal block connecting arrangement as defined in claim 3, wherein said connecting means includes;

(1) a frame (11) rigidly connected with said electrical apparatus ; and (2) first guide means (13) guiding said test terminal block for transverse displacement relative to said frame.

5. A terminal block arrangement as defined in claim 4, wherein said frame is integral with said electrical apparatus.

6. A terminal block arrangement as defined in claim 4, wherein said frame is a separate element attached to said electrical apparatus.

7. A terminal block connecting arrangement as defined in claim 4, wherein said first spring means comprises a tension spring (16) connected between said test terminal block and said frame.

8. A terminal block connecting arrangement as defined in claim 7, wherein said detent means comprises:

(1) a lever (21) having a first end portion (21*a*) pivotally connected with said frame for pivotal movement about a vertical pivot axis (20);

(2) a detent roller (23) connected with said lever for rotation about a vertical pivot axis (24); and (3) second spring means (22) biasing said lever in a direction to introduce said detent roller into a corresponding locking recess (21) contained in said test terminal block.

9. A terminal block connecting arrangement as defined in claim 8, wherein said frame includes:

(a) a horizontal planar portion (11*a*) arranged above said test terminal block;

(b) a pair of vertical side wall portions (11*b*) extending downwardly from the side edges of said planar portion in a direction parallel with said given direction, said test terminal block extending transversely between said side wall portions; and (c) a pair of horizontal support flange portions (11*c*) extending inwardly from the lowermost extremities of said side wall portions;

and further wherein said first guide means comprises a pair of vertical end walls (14, 15) connected with the opposite ends of said test terminal block, respectively, said end walls being slidably supported on said support flanges, respectively.

10. A terminal block connecting arrangement as defined in claim 9, and further including:

(g) second guide means (7) guiding said first terminal block for horizontal displacement relative to said frame during the displacement of said first terminal block between said intermediate and connect positions.

11. A terminal block connecting arrangement as defined in claim 9, wherein said lever (21)has a second end portion (21*b*), said detent roller being arranged intermediate the ends of said lever; wherein said second spring means comprises a compression spring (22) arranged between said lever second end portion and the associated frame vertical side wall; and further wherein said recess (25) is contained in the end extremity of the associated end wall of said test terminal block, whereby when said first terminal block is displaced from said intermediate position toward said connect position, the biasing force of said compression spring is overcome, and said lever is pivoted to disengage said detent roller from said locking recess.

* * * * *